United States Patent [19]

Odell, II et al.

[11] Patent Number: 4,459,783

[45] Date of Patent: Jul. 17, 1984

[54] WORKPIECE WEIGHING SYSTEM FOR CONDITIONING GRINDERS

[75] Inventors: Jack L. Odell, II; Robert F. Obear, both of Snohomish County, Wash.

[73] Assignee: Western Gear Machinery Co., Everett, Wash.

[21] Appl. No.: 404,701

[22] Filed: Aug. 3, 1982

[51] Int. Cl.[3] ..... B24B 49/00

[52] U.S. Cl. ..... 51/165.74; 51/45; 51/35; 51/165 R; 51/5 R; 177/50; 177/245

[58] Field of Search ..... 177/245, 50; 51/289 R, 51/35, 45, 165 R, 165.72, 165.73, 165.74, 165.92, 5

[56] References Cited

U.S. PATENT DOCUMENTS

| | | | |
|---|---|---|---|
| 2,694,960 | 11/1954 | Kahle | 177/245 |
| 2,962,938 | 12/1960 | Buigne | 177/245 |
| 3,081,194 | 3/1963 | Hunsberger | 177/50 |
| 4,001,980 | 1/1977 | Wallin | 51/165.72 |
| 4,014,142 | 3/1977 | Coes, Jr. | 51/165.92 |
| 4,248,019 | 2/1981 | Hawley | 51/35 |

*Primary Examiner*—Harold D. Whitehead
*Attorney, Agent, or Firm*—Seed and Berry

[57] ABSTRACT

A weighing system for a grinding machine which calculates the weight of material removed by the grinding machinery during a grinding procedure. Power signals from a watt meter indicate the power consumed by the motor driving the grinding wheel. The weight of the material removed since the previous calculation is then periodically calculated from the power signals. This incremental weight removal value is then added to the sum of a previously calculated incremental weight removal values to provide an indication of the total weight removed from the workpiece. The calculation also includes a coefficient indicative of the grinding efficiency of the grinding wheel which, in turn, is a function of the density and hardness of the material in the workpiece, the grinding characteristics of the grinding wheel, and the peripheral velocity of the grinding wheel. The peripheral velocity may be calculated by multiplying a signal from a tachometer that is proportional to grinding wheel rotational velocity by the radius of the grinding wheel. The radius of the grinding wheel may be determined by sensing the position of the grinding wheel spindle when the grinding wheel makes contact with the workpiece and comparing this position to the position of a manipulator car carrying the workpiece and the height of the workpiece.

7 Claims, 4 Drawing Figures

WORKPIECE WEIGHING SYSTEM FOR CONDITIONING GRINDERS

TECHNICAL FIELD

This invention relates to grinding machinery for workpieces, such as billets, and, more particularly, to a system for weighing the amount of material removed from the workpiece during grinding.

BACKGROUND ART

The need exists in a large number of fields to perform grinding operations on workpieces. For example, a billet is often the raw material for a rolling process in which the billet is flattened and formed into a finished product. These billets often contain surface imperfections which, if not removed, are carried through to the finished product. Accordingly, these imperfections are normally removed in a grinding process called "spotting" in which a rotating grinding wheel is held against the surface imperfection until the surface imperfection is removed. The surfaces of billets are also normally coated with a layer of oxides and other material. This surface layer must also be removed in order to prevent the surface layer from degrading the quality of the finished product. The surface layer is normally removed in a process called "skinning" in which the billet reciprocates beneath the grinding wheel while the grinding wheel is held in contact with the billet. The skinning process is often performed in an automatic mode in which the grinding pressure of the wheel against the workpiece is automatically maintained at either a constant value or a value which provides a desired function, such as constant grinding torque or power.

In most grinding processes, including skinning and spotting operations on billets, it is desirable to measure the amount of material removed. This is conventionally done by weighing the workpiece before grinding and then once again weighing the workpiece after grinding. The difference in weight is, of course, equal to the weight of material removed. The disadvantages of this conventional technique are twofold. First, a relatively small percentage of the billet's weight is removed during the grinding process. Thus, a weighing error that represents a relatively small fraction of the billet's weight can result in a relatively large error in determining the weight of material removed. For example, a scale having a 0.1% accuracy would be capable of weighing a 200 lb. billet to within 0.2 lb. Yet, in a grinding operation removing just one pound of the billet material, the 0.1% weighing error produces a 20% error in measuring the weight of the material removed. A weighing error of 0.1% can be achieved only with relatively delicate and expensive scales employing sophisticated load cells. The initial expense and expense of repairing such scales when subject to hard use by heavy workpieces makes the conventional weighing procedure very costly.

The second disadvantage of the conventional technique for measuring the weight of material removed is the cost of manipulating the workpiece to perform the weighing operations. For example, a billet, which is extremely heavy, must first be carried from a charging table to a scale. The billet is then carried from the scale to a carriage that supports the billet during grinding. Finally, before being carried to a downstream conveyor, the billet must be carried back to the scale for another weighing. The time-consuming and, hence, expensive nature of these procedures is apparent.

Although conventional grinding operations are being described in some detail with respect to billets, it will be understood that the principles of the invention applicable to billets are also equally applicable to other grinding processes.

DISCLOSURE OF THE INVENTION

It is an object of the invention to provide a relatively inexpensive and sturdy system for measuring the weight of material removed from a workpiece during grinding.

It is another object of the invention to weigh the amount of material removed from a workpiece during grinding without the need to manipulate the workpiece.

It is still another object of the invention to provide an extremely accurate technique for measuring the amount of material removed from a workpiece even when the amount of material removed is a relatively small percentage of the weight of the workpiece.

It is a further object of the invention to provide a system for weighing the amount of material removed from a workpiece which does not require manual intervention by an operator.

These and other objects of the invention are provided by a system which continuously calculates the amount of material removed in real-time during the grinding process. The system first calculates the grinding coefficient from the peripheral velocity of the grinding wheel as measured by a tachometer and a grinding wheel position sensor. The grinding coefficient is then periodically multiplied by a function of the horsepower being drawn by the grinding motor as measured by a watt meter and integrated over the duration of the grinding process to calculate the weight of material removed.

DESCRIPTION OF THE PREFERRED EMBODIMENT

Figure 1:
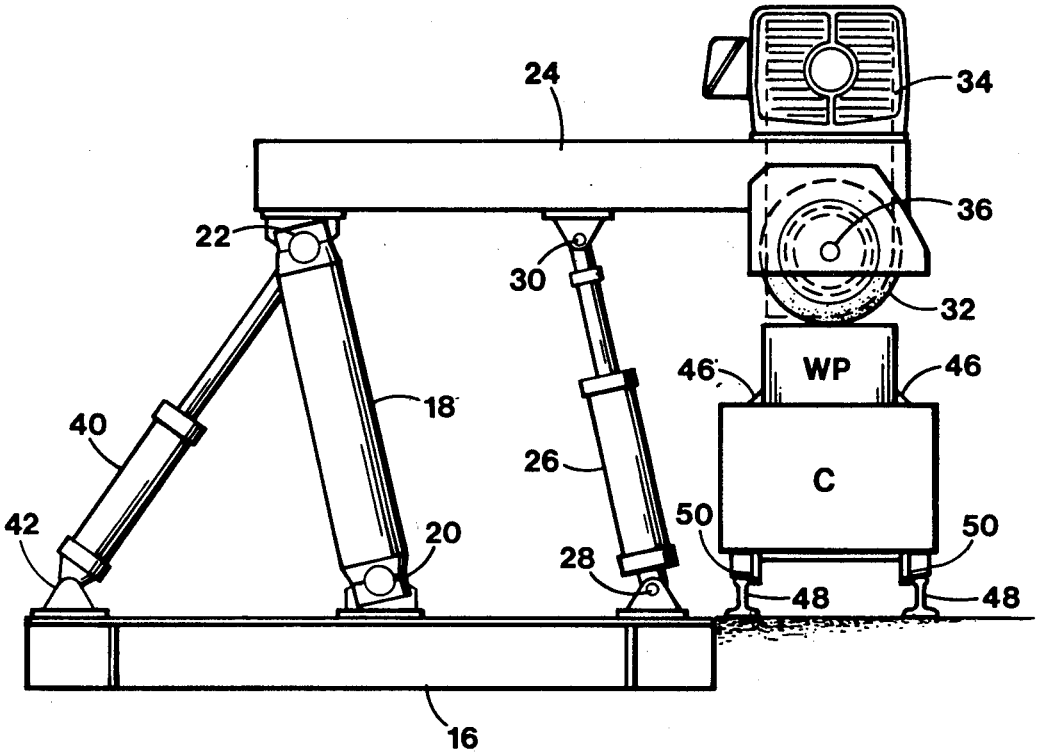
FIG. 1 is an end elevational view of a typical apparatus for grinding a workpiece such as a billet.
Figure 2:
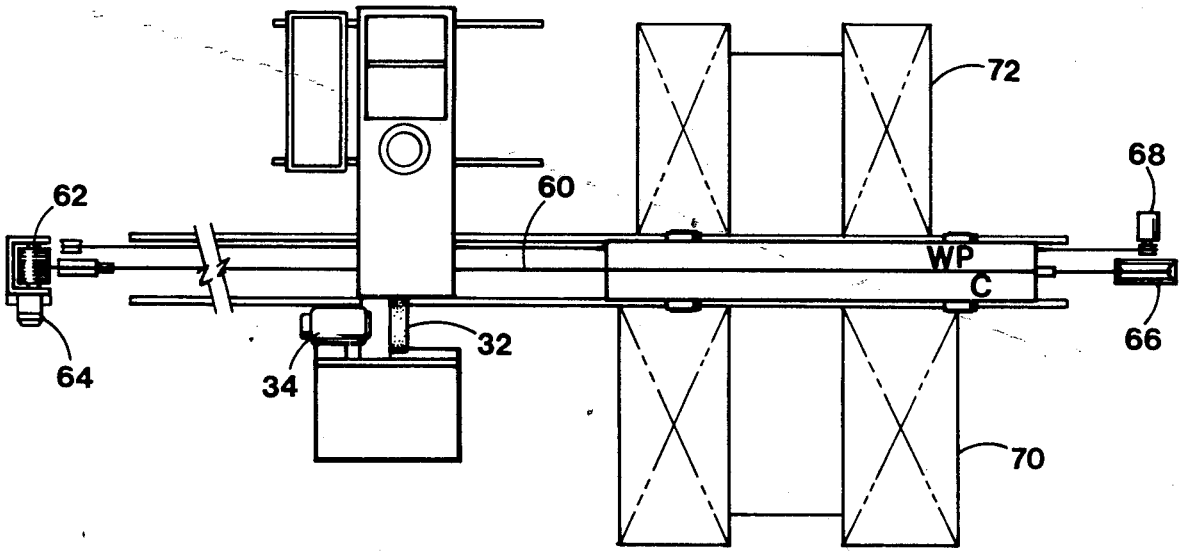
FIG. 2 is a top plan view of the grinding apparatus of FIG. 1.

A typical apparatus for grinding workpieces, such as billets, is illustrated in FIGS. 1 and 2. With reference to FIG. 1, the apparatus includes a stationary, rigid floor frame 16, from which a support 18 is pivotally mounted at 20. The opposite end of the pivotal support 18 is pivotally secured at 22 to a horizontally disposed grinding wheel support 24. A conventional hydraulic actuator 26 is also pivotally mounted to the floor frame 16 at 28 and to the grinding wheel support 24 at 30. Although the distance between the pivotal connections 28, 30 can be adjusted, the adjustment is relatively slight so that the pivotal support 18 and hydraulic actuator 26 approximate a parallelogram. A grinding wheel 32 mounted on a motor 34 through a spindle 36 is carried at the end of the horizontally disposed grinding wheel support 24. Hydraulic fluid flowing into and out of the hydraulic actuator 26 in a conventional manner produces primarily vertical movement of the grinding wheel 32.

The parallelogram structure of the support 18 and hydraulic actuator 26 cause a second hydraulic actuator 40 to produce primarily horizontal movement of the grinding wheel 32. The hydraulic actuator 40 is pivotally connected to the floor frame 16 at 42 and to the grinding wheel support arm 24 at 22.

During grinding, the workpiece WP is carried by a manipulator car C and is securely held thereon by clamp members 46. The car C is supported on rails 48 by a pair of wheels 50. The car C and, hence, the WP reciprocate beneath the grinding wheel 32 as the car C moves along the rails 48. As illustrated in further detail in FIG. 2, a cable 60 connected to one end of the carriage C engages a drum 62 which is rotated by a hydraulic motor 64 in accordance with a control signal in a conventional manner. The cable 60 extends beneath the rails 48 and engages a freely rotating sheave 66 at the other end of the rails 48. Thus, rotation of the drum 62 moves the carriage C along the rails 48. The position of the car C and, hence, the workpiece WP with respect to the grinding wheel 32, is measured by a rotary encoder 68 rotating with the sheave 62.

In conventional operation, a workpiece WP, such as a billet, is initially placed on a conventional charge table 70 after the workpiece has been weighed. The carriage C is then moved along the rails 48 and the workpiece is loaded onto the carriage C by conventional handling means. The carriage C then moves toward a position beneath the grinding wheel 32 and the grinding wheel 32 is lowered into contact with the workpiece WP. The workpiece WP then reciprocates beneath the grinding wheel 32 and the hydraulic actuator 40 is energized to move the grinding wheel support arm 24 horizontally to contact specific portions of the surface of the workpiece WP. After grinding, the carriage C is moved along the rails 48 to a discharge position, where the workpiece WP is loaded onto a conventional discharge table 72 by conventional handling means. The workpiece WP is then weighed to determine the weight of material removed.

The operation of the grinding apparatus illustrated in FIGS. 1 and 2 may be either manual or automatic. In either case, the workpiece WP is normally loaded on the car C by manual means, thus providing an electrical indication that a new workpiece WP has been loaded on the car C for use by the inventive weighing system as explained hereinafter.

The above described grinding apparatus, as mentioned above, is one design used to grinding elongated workpieces such as billets. However, other types of grinding apparatus are also used to perform grinding operations on workpieces of various types. Thus, although the inventive weighing system is described with reference to the grinding apparatus of FIGS. 1 and 2, it will be understood that the inventive weighing system can also be used with other grinding apparatuses.

The inventive measuring system for weighing the amount of material removed operates in real-time to periodically calculate the incremental removal weight during the interval from the previous calculation. The weight of material removed is calculated primarily from the power drawn by the motor 34. For this purpose, a conventional watt meter 100 is connected with the power lines driving the motor 34, and it generates an output having a voltage proportional to the power drawn by the motor. This analog voltage is transformed into a corresponding digital word by a conventional analog-to-digital (A/D) converter 102. The digital output of the A/D converter is applied to a controller 104 which is a conventional microprocessor operating in accordance with program instructions described in detail hereinafter. The controller 104 may also receive a digital word indicative of the rotational velocity of the grinding wheel 32. For this purpose, a conventional spindle tachometer 106 measures the rotational velocity of the grinding wheel 32 and generates an analog output proportional thereto. This analog output is transformed to a corresponding digital word by A/D converter 108 and applied to the controller 104. In the event that either the watt meter 100 or spindle tachometer 106 itself generates a digital output, the respective A/D converters 102, 108 may, of course, be eliminated.

The controller 104 also receives manually entered data through conventional keyboard 110 through a buffer or digital-to-digital (D/D) converter 112.

After the controller 104 calculates the weight of material removed during a grinding operation, it outputs the weight calculation to an appropriate peripheral device. For example, the controller 104 may program a video display generator 120 which drives a video monitor 122 so that the video monitor 122 provides a visual indication of the weight of material removed. As is well known in the art, the video display generator 120 contains internal random access memory corresponding to a matrix of locations on the screen of the video monitor 122. Messages are printed on the video monitor 122 by designating a combination of areas on the screen of the video monitor 122 to be of an intensity or color contrasting with the surrounding area of the screen. The controller 104 updates the memory in the video display generator 120 by periodically applying update data to an internal buffer in the video display generator 120. The video display generator 120 then reads the data from the buffer and writes it into the appropriate memory location in the video display generator 120 while the display generator 120 is causing the video monitor 122 to retrace.

The controller 104 may also output the material removal weight indication in other formats. For example, the controller 104 may apply the material removal data to another logging device 124 such as a printer through a conventional RS-232 port 126.

As explained in detail hereinafter, certain calculations performed by the controller 104 need only be performed once for each workpiece WP or only during the first pass of the grinding wheel 32 over the workpiece. To determine the status of the grinding operation, the controller 104 receives inputs from portions of the grinding apparatus illustrated in FIGS. 1 and 2. When the grinding apparatus operator loads a workpiece WP from the charging table 70 onto the carriage C, an appropriate signal is generated by a control console 140 for the grinding apparatus. This signal from the control console 140 informs the controller 104 that a new workpiece WP is being loaded onto the car C. The controller 104 is also able to determine whether the grinding apparatus is on its first grinding pass over the workpiece WP by examining the output of the car position encoder 68 (FIG. 2). The car positioning encoder 68 generates a digital output which is applied to the controller 104 through a buffer or D/D converter 142. As mentioned above, the grinding coefficient of the grinding apparatus is a function of the peripheral velocity of the grinding wheel 32. Since the peripheral velocity of the grinding wheel 32 depends on the radius of the grinding wheel 32, it may be important for the controller 104 to be able to calculate the radius of the grinding wheel 32. Accordingly, potentiometers 150, 152 generate outputs indicative of the angle of the support 18 about pivot points 20 and 44, respectively. The analog outputs from the potentiometers 150, 152 are applied to the controller 104 through respective A/D converters 154, 156. From the digital words output by A/D converters 154, 156, the controller 104 is able to determine the vertical position with respect to a fixed reference of the spindle 36 of the grinding wheel 32. The radius of the grinding wheel 32 is then calculated by subtracting from the position of the spindle 36, the height of the car C with respect to a fixed reference (which is a known quantity), and the height of the workpiece WP (which is entered through keyboard 110).

The controller 104 also receives a signal from a time base 160 which determines the operating speed of the controller 104 and the frequency at which incremental material removal calculations are made.

Although the above embodiment is described as utilizing a spindle tachometer 106 and potentiometers 150, 152 for allowing the peripheral velocity of the grinding wheel 32 to be calculated, it will be understood that this may not be necessary for some types of grinding apparatus. Grinding motors 34 exist which are capable of causing the grinding wheel 32 to rotate at a relatively constant rotational velocity even when the motor 34 is subject to widely varying loads. Under these circumstances, the spindle tachometer 106 could certainly be eliminated. Moreover, in the event that the radius of the grinding wheel 32 remained relatively constant or at least changed somewhat slowly, the radius of the grinding wheel 32 could be measured and entered manually through the keyboard 110. This would eliminate the need for the potentiometers 150, 152 and associated A/D converters 154, 156, respectively.

Figure 3:
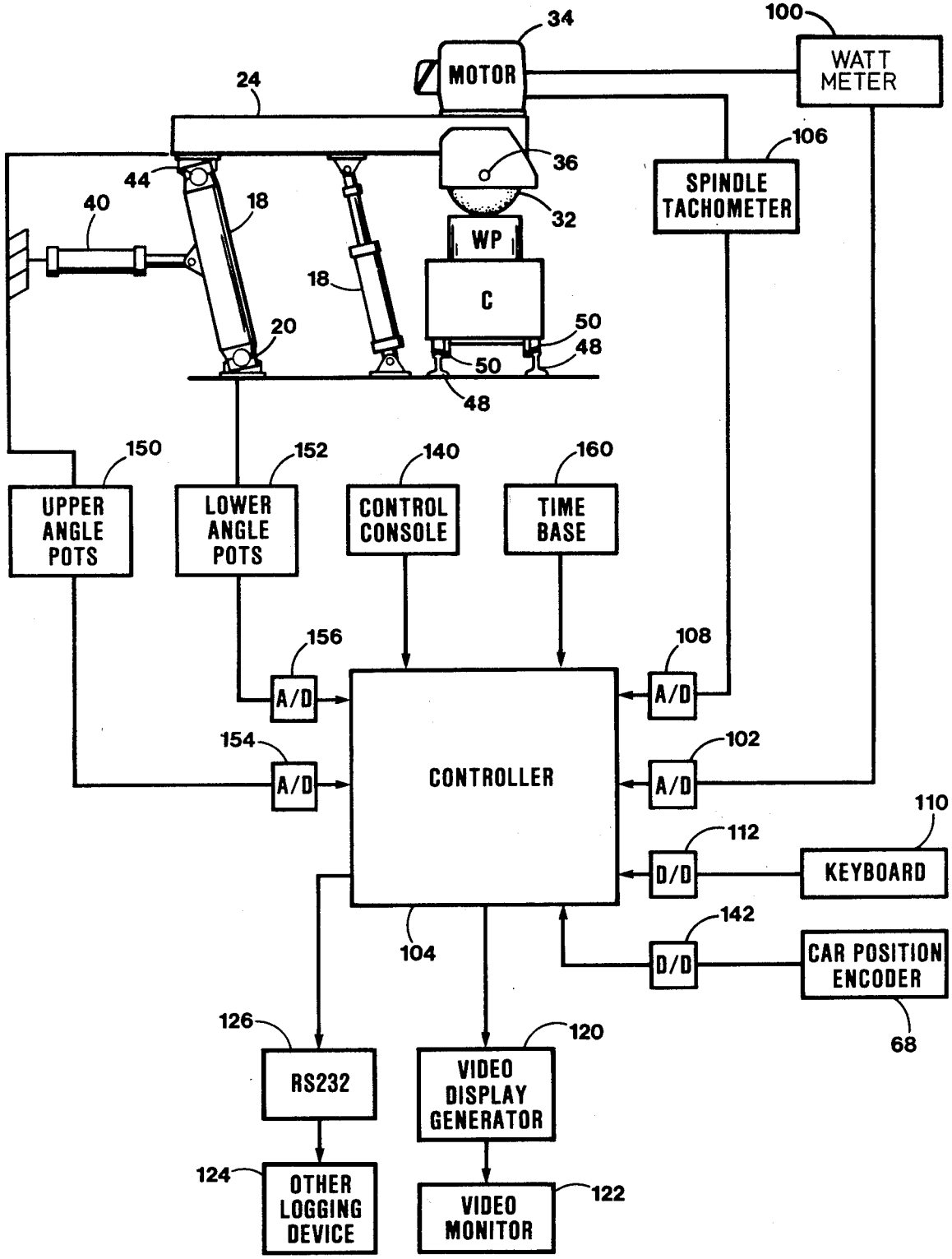
FIG. 3 is a block diagram of the inventive system for measuring the weight of material removed from the workpiece during grinding.
Figure 4:
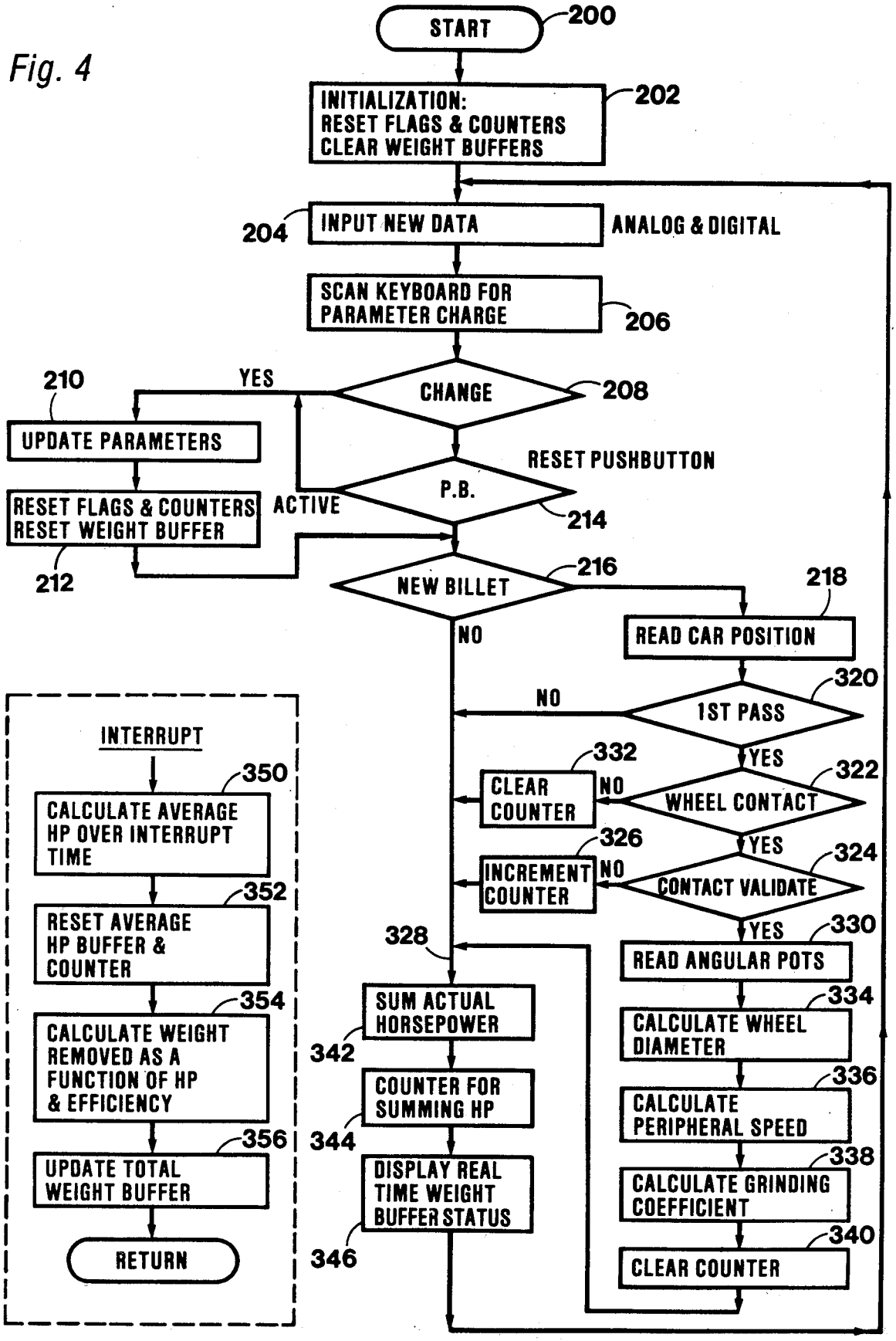
FIG. 4 is a flow chart of the software controlling the operation of a portion of the hardware illustrated in FIG. 3.

A flow chart of the software for operating the controller 104 is illustrated in FIG. 4. The program is entered at 200 and initialization procedures are accomplished at 202 in which various flags and counters are reset and the weight buffer which stores the total weight of material removed from a workpiece is cleared. The program then proceeds to 204 where data from external sources explained above in reference in FIG. 3 are input to the controller 104. The keyboard 110 is scanned at 206 to determine if any of the operating parameters have changed from which the weight of material removed is calculated. Assuming that a change in operating parameters has been found at 208 to have occurred, the program proceeds to 210 where these parameters are updated in internal buffers. Finally, internal flags and counters and the weight buffer are reset at 212. The reset function occurs because changing the operating parameters at any point during the grinding process would, of course, produce inaccurate results and would thus not normally be accomplished. Instead, the operating parameters are normally changed only before or after a grinding operation, thus making a reset of the flags, counters and weight buffer desirable. The flags, counters and weight buffer should also be reset each time a new workpiece WP is loaded onto the car C. Accordingly, the signal produced by a push-button on the control console 140 when a new workpiece is loaded is detected at 214 to cause the program to also route through steps 210 and 212.

Actuation of the push-button also sets a "new billet" flag which is detected at 216 if a new billet has been loaded onto the car C. The system then determines if the grinding machine is on the first pass of the new billet by reading the car position at 218. This determination is made by noting that the position of the car C continues to change in one direction as the car C approaches the grinding wheel 32 from the charging table 70. When the position of the car C starts to change in the opposite direction, the first pass is considered completed. A first pass is detected at 320 to cause the program to proceed to 322 where contact between the grinding wheel 32 and the workpiece WP is detected. This step is accomplished by examining the output of the watt meter 100 for a power indication larger than a predetermined value. When the grinding wheel 32 is not in contact with the workpiece WP, the power drawn by the motor 34 is relatively low. As the grinding wheel 32 makes contact with the workpiece WP, the power drawn by the motor 34 greatly increases and is detected at 322 to cause the program to step to 324. At 324, an internal counter is examined to determine if the count has reached a predetermined value. If not, the counter is incremented at 326. The program then proceeds to branch 328 where the horsepower measurements are recorded, as explained in greater detail below. After passing through branch 328, the program is once again routed through 324 (assuming that the grinding wheel 32 is still in contact with the workpiece WP), thereby once again incrementing the counter 326. After a predetermined number of successive passes, the counter has reached the predetermined number as detected at 324, thereby causing the program to proceed to 330. The process of incrementing the counter to detect contact between the grinding wheel 32 and the workpiece WP ensures that the contact indication is not provided by noise on the lines containing the horsepower signal because the counter can only be incremented if the horsepowers above are predetermined periods at several points in time. If, at any time during the count, the grinding wheel 32 loses contact with the workpiece WP, the counter is cleared at 332, thus requiring that the count be started from zero once again. Thus, when the program proceeds to 330, a determination has been made that the grinding wheel 32 has just recently made contact with the workpiece and that it is now appropriate to measure the position of the spindle 36 to calculate the radius of the grinding wheel 32. Accordingly, the potentiometers 150, 152 are read at 330 and the diameter of the grinding wheel 32 is calculated at 334. The peripheral speed is then calculated at 336 by multiplying the signal from tachometer 106 entered at 204 by the wheel radius calculated at 334. Finally, the grinding coefficient is calculated at 338 as a linear function of the peripheral speed calculated at 336. This grinding coefficient for one operational embodiment is $\alpha = V \times 2.5 \times 10^{-5} + 0.5875$, where V is the peripheral velocity of the grinding wheel 32. The formula for calculating the grinding coefficient for other grinding machines can be determined empirically by known techniques. The internal counter incremented at 326 is then cleared at 340 before proceeding to branch 328.

Upon entering branch 328, the horsepower sample from watt meter 100 which has been input at 204 is added to the sum of previously input horsepower readings at 342. The number of horsepower readings making up the sum calculated at 342 is counted at 344 and the contents of the weight buffer indicative of the amount of weight removed during the grinding operation so far is output to a display, such as the video display generator 120 at 346. The program then returns to 204, and at 216 detects a flag set at 218 and proceeds directly from 216 to 342. The program then remains in this loop until an interrupt occurs.

The frequency of the interrupt is determined by the time base 160. When an interrupt occurs, the average horsepower is calculated at 350 from the horsepower readings input at 204 over the period from the previous interrupt. The calculation is made by merely dividing the sum of the actual horsepower from 342 by the number of horsepower readings from 344. The average horsepower buffer to which a horsepower reading is summed at 342 is reset at 352, as is the counter for summing the number of horsepower readings at 344. The weight of the material removed since the previous interrupt is then calculated at 354 to provide an incremental removal weight value which is summed with previously calculated incremental material removal weights at 356. The weight buffer thus indicates the weight of the material removed up until any point in time during the grinding process. It is this value that is output to a display at 346.

The weight removed is calculated at 354 as a function of horsepower calculated at 350 and the grinding coefficient calculated at 338. The weight removal W is given by the formula $W=\int(A_1\,\mathrm{HP}+A_2)\,(\alpha)\,dt$, where $A^1$ and $A_2$ are calibrating constants, HP is the power used by the the grind wheel motor 34 and $\alpha$ is the grinding coefficient. In one operational embodiment, the incremental weight removed W is calculated as $[2.75\times10^{-6}$ lb./HP$^2$ sec.] (HP)+$[1.39\times10^{-3}$ lb./HP sec.], where HP is the average power used by the motor 34 during the integration period during which the incremental weight was ground. The constants $A_1$ and $A_2$ used to calculate the grinding efficiency can be determined for other grinding machines empirically and, where greater accuracy is needed, the grinding efficiency of horsepower may be calculated from a higher order equation, such as a quadratic equation, more closely approximating the experimentally obtained relationship between grinding efficiency and horsepower.

We claim:

1. A system for measuring the weight of material removed from a workpiece by a grinding wheel driven by an electric motor during a grinding operation, comprising:

power measuring means for periodically measuring the power used by said electric motor and for generating a power signal indicative thereof;

controller means for calculating a grinding coefficient and then periodically multiplying said grinding coefficient by a function of said power signal to determine an incremental weight removal value indicative of the weight removed since any previous multiplication, said controller means further adding said incremental weight removal value to any previously determined incremental weight removal values to determine the total weight of material removed up to that point in time during said grinding operation; and display means receiving an input from said controller means for generating a visually perceptible indication of the total weight of material removed as determined by said controller.

2. The weight measuring system of claim 1, wherein said grinding coefficient is a function of the peripheral velocity of said grinding wheel, and said system further includes tachometer means for generating a tachometer signal indicative of the rotational velocity of said grinding wheel, and wherein said controller means further calculates the peripheral velocity of said grinding wheel by multiplying said tachometer signal by the radius of said grinding wheel.

3. The weight measuring system of claim 2, wherein said controlled means further receives data indicative of the height with respect to a fixed reference of the manipulator car carrying said workpiece and the thickness of said workpiece, said system further comprising:

position sensing means for measuring the vertical position of the center of said grinding wheel with respect to said fixed reference; and memory means for detecting when said grinding wheel first makes contact with said workpiece and for then recording at that time the vertical position of the center of said grinding wheel, thereby allowing said controller means to calculate the radius of said grinding wheel as the position of said grinding wheel less the height of said manipulator car and the thickness of said workpiece.

4. The weighing system of claim 3, further including means for generating an initialization signal upon loading of a new workpiece on said manipulator car, and position sensing means for generating a position signal indicative of the longitudinal position of said manipulator car as it moves longitudinally beneath said grinding wheel, said controller receiving said initialization and position signals and examining said position signal upon receipt of an initialization signal to determine if said manipulator car is in its first grinding pass, said controller means performing said grinding wheel radius calculation only during the first grinding pass to optimize the operating efficiency of said controller means.

5. The weighing system of claim 3, wherein said controller means determines that said grinder wheel has made contact with said workpiece by periodically examining said power signal and incrementing a counter for each time that said power signal is above a predetermined value until said counter has been incremented to a predetermined value in order to reject noise-induced indications of contacting said power signal.

6. The weighing system of claim 5, wherein said counter is reset to zero upon receipt of a power signal that is less than said predetermined value.

7. The weighing system of claim 1, wherein said controller means records a plurality of said periodic power measurements before calculating said incremental weight removal value, said controller means summing said measurements and counting the number of said measurements to determine the average power measurement before calculating from said average power measurement said incremental weight removal value.

* * * * *